US007504000B2

(12) United States Patent
Richard

(10) Patent No.: US 7,504,000 B2
(45) Date of Patent: Mar. 17, 2009

(54) METHOD FOR PRODUCING A SHEET OF PAPER COMPRISING CALCITE

(75) Inventor: Christian Richard, Chambery (FR)

(73) Assignee: Arjowiggins, Issy les Moulineaux (FR)

( * ) Notice: Subject to any disclaimer, the term of this patent is extended or adjusted under 35 U.S.C. 154(b) by 99 days.

(21) Appl. No.: 10/467,461

(22) PCT Filed: Feb. 14, 2002

(86) PCT No.: PCT/FR02/00574

§ 371 (c)(1),
(2), (4) Date: Jan. 20, 2004

(87) PCT Pub. No.: WO02/066735

PCT Pub. Date: Aug. 29, 2002

(65) Prior Publication Data

US 2004/0118542 A1 Jun. 24, 2004

(30) Foreign Application Priority Data

Feb. 16, 2001 (FR) ..... 01 02186

(51) Int. Cl.
*D21H 17/63* (2006.01)
*D21H 23/02* (2006.01)
*C01F 11/18* (2006.01)

(52) U.S. Cl. ..... 162/181.2; 162/181.1; 162/183; 162/189; 423/419.1; 423/432; 423/640

(58) Field of Classification Search ..... 162/181.1, 162/181.2, 183, 189; 423/419.1, 432, 640
See application file for complete search history.

(56) References Cited

U.S. PATENT DOCUMENTS 3,321,269 A * 5/1967 Eizo Yasui et al. ..... 423/431
3,458,329 A * 7/1969 Hatch et al. ..... 428/493
3,578,603 A * 5/1971 Dale et al. ..... 252/301.4 P
4,124,688 A * 11/1978 Shibazaki et al. ..... 423/432
4,781,818 A * 11/1988 Reagan et al. ..... 208/251 R
4,818,373 A * 4/1989 Bartholic et al. ..... 208/252
5,232,678 A * 8/1993 Bleakley et al. ..... 423/432
5,262,006 A 11/1993 Andersson et al.
5,494,651 A * 2/1996 Minayoshi et al. ..... 423/432
5,679,220 A 10/1997 Matthew et al.
5,695,733 A * 12/1997 Kroc et al. ..... 423/432
5,792,440 A * 8/1998 Huege ..... 423/432
5,851,655 A * 12/1998 Tokiyoshi et al. ..... 428/330
6,251,222 B1 * 6/2001 Silenius et al. ..... 162/9
6,251,356 B1 * 6/2001 Mathur ..... 423/432
6,310,129 B1 * 10/2001 Lilly et al. ..... 524/424
6,387,212 B1 * 5/2002 Christian ..... 162/9
6,706,148 B1 * 3/2004 Joisson et al. ..... 162/181.6
2003/0094252 A1 5/2003 Sundar et al.

FOREIGN PATENT DOCUMENTS

WO WO 99/42657 A1 8/1999

OTHER PUBLICATIONS

English translation of WO 99/42657 A1, Aug. 26, 1999, France, Christian Richard.*

* cited by examiner

*Primary Examiner*—Eric Hug
*Assistant Examiner*—Dennis Cordray
(74) *Attorney, Agent, or Firm*—Birch, Stewart, Kolasch & Birch, LLP

(57) ABSTRACT

The invention relates to a method for producing a sheet of paper (6) comprising paper fibres and calcium carbonate mainly in the form of calcite crystals linked directly to the paper fibres. The inventive method is characterised in that it comprises the following steps:—(i) an aqueous composition comprising calcium bicarbonates (5) and/or hydrated and/or dissolved carbon dioxide (3) and (ii) an aqueous composition comprising calcium hydroxide (4) are mixed in an aqueous medium in such a way as to precipitate the calcium carbonate in the form of vaterite crystals;—paper fibres (2, 2') are immediately added;—the vaterite crystals are left to transform into calcite crystals on contact with the fibres;—said mixture containing the calcite crystals which are fixed to the fibres is subsequently sent on the conveying wire of the papermaking machine (M) for drainage and so that the sheet of paper can be formed;—the sheet of paper (6) thus obtained is treated, if necessary, and dried.

14 Claims, 2 Drawing Sheets

METHOD FOR PRODUCING A SHEET OF PAPER COMPRISING CALCITE

Figure 1:
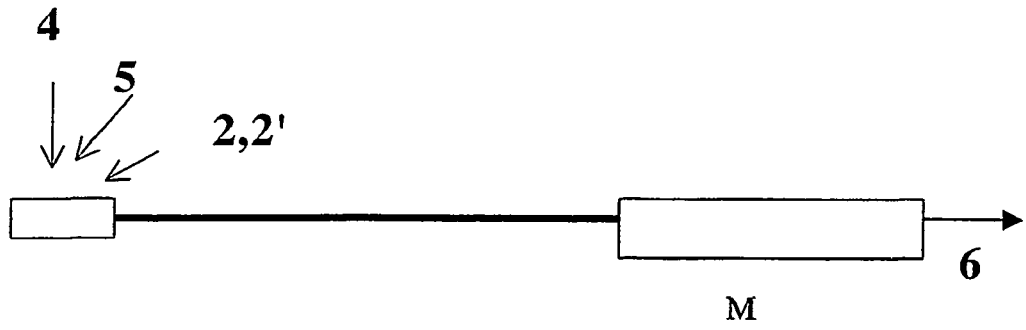

This application is the national phase under 35 U.S.C. § 371 of PCT International Application No. PCT/FR02/00574 which has an International filing date of Feb. 14, 2002, which designated the United States of America.

The present invention concerns a process for the manufacture of a sheet of paper containing calcium carbonate in the form of calcite.

Various types of paper are known to contain mineral fillers, in order, on one hand, to reduce their costs, since the fillers are less expensive than cellulose fibers, and, on the other hand, to provide or improve certain physical and mechanical characteristics. Materials specifically used as fillers are kaolin, talc, titanium oxide, aluminum hydroxide, satin white, and calcium carbonate in ground or precipitated form. The classic method for these fillers involves preparation ex situ at the time of manufacture of the paper; they are incorporated into the paper fibers and retained through the addition of retention agents.

The development of paper manufacturing in an alkaline environment, in order to make the paper more durable, has led to wider use of calcium carbonate.

Calcium carbonate presents a number of crystallographic forms. The most stable and most commonly-used form is calcite; another, somewhat less frequently used form is aragonite; the least stable form is vaterite. Calcite and aragonite crystals are rhombohedral in shape, whereas vaterite crystals are spherical.

Paper-making processes have been proposed which enable the calcium carbonate to be precipitated in situ onto paper fibers and fixed without the addition of retention agents.

Such processes have been described in the patents listed below.

Patent application WO 9942657 describes a new process for the synthesis of calcium carbonate in the presence of cellulose fibers, so as to obtain, at the end of the process, a calcium carbonate precipitate in situ on the fibers. This process is characterized by the inclusion of:

- a stage involving the realization of a first aqueous composition containing calcium bicarbonate (also known as calcium hydrogen carbonate), which can be obtained by processing calcium carbonate with carbon dioxide;
- a stage involving the realization of a second aqueous composition containing calcium hydroxide; and
- a final stage in which the first and second compositions are mixed with cellulose fibers, in such a way as to cause the precipitation of calcium carbonate upon contact with at least some fibers.

When all of these three ingredients are present, the calcium carbonate crystals are fixed onto the fibers, and a higher level of retention is obtained than when calcium carbonate is added to a paper composition that requires retention agents. This process is implemented in the dilute medium typically used in the paper-making process.

U.S. Pat. No. 5,679,220 also describes a method of fixing precipitated calcium carbonate onto paper fibers in a paper-making process using cellulose fibers, calcium hydroxide and carbon dioxide under high shearing as a precipitating gas. The patent envisages a variation in the molar ratio of the carbon dioxide to the calcium hydroxide in order to obtain calcium carbonate crystals of different morphologies. Nonetheless, this patent does not clearly show how to obtain the desired crystallographic form of calcium carbonate.

The objective of the present invention is to provide a sheet of paper that contains calcium carbonate in its common form of calcite and that has improved "look-through."

The applicant has shown that it is possible to act on crystallographic forms of calcium carbonate through the use of the in situ precipitation process of calcium carbonate, by adjusting the order and the durations of contact between the various compositions involved, in order to precipitate and fix the calcium carbonate onto the fibers in situ when a sheet of paper is being manufactured. He has shown that the calcium carbonate precipitated according to in situ processes initially crystallizes in the form of vaterite, which is unstable before being transformed into its more stable form of calcite, and that this passage from vaterite to calcite could be controlled and used at the time of manufacture of the sheet of paper, in order to improve the fixation and distribution of the calcium carbonate crystals, in calcite form, within the paper.

The invention provides a process for the manufacture of a sheet of paper containing paper fibers and calcium carbonate, mostly in the form of calcite crystals directly linked to the paper fibers, wherein said process includes the following stages:

- mixing, in an aqueous medium, of:
  - an aqueous composition containing calcium hydrogen carbonates and/or hydrated and/or dissolved carbon dioxide,
  - an aqueous composition containing calcium hydroxide, so as to precipitate calcium carbonate in the form of vaterite crystals,
- immediately adding paper fibers,
- allowing the vaterite crystals to be transformed into calcite crystals upon contact with the fibers,
- placing this mixture containing the calcite crystals fixed to the fibers onto the wire of the paper-making machine for drainage and formation of the sheet of paper,
- processing (if necessary) and drying of the sheet of paper thus obtained.

Preferably, the paper-manufacturing process is characterized by the fact that the composition containing calcium hydroxide is added after the composition containing calcium hydrogen carbonates and/or hydrated and/or dissolved carbon dioxide.

Preferably, the paper-manufacturing process is characterized by the fact that the composition containing calcium hydrogen carbonates results from a mixture, in an aqueous medium, of recycled calcium carbonate and carbon dioxide.

Preferably, the recycled calcium carbonate comes from recycled paper products, specifically recycled paper fibers and/or recycled white water.

Recycled white water originates in the water drained from the fibrous suspension on the wire of the paper-making machine. It contains fine elements, specifically fillers, such as calcium carbonate, and possibly other alkaline or alkaline-earth compounds and cellulose fibers (called "fine" fibers) which are not retained on the wire, these fibers themselves containing fillers. Like other possible sources of recycled paper products, there are recycled paper fibers which originate in old papers, specifically de-inked and possibly bleached papers, and recycled "casse paper"; these products also contain fillers, such as calcium carbonate and possibly other alkaline or alkaline-earth compounds. Another source might be de-inking sludge and other types of sludge from the paper-making process.

According to a particular embodiment of the invention, the carbon dioxide is added in different places in the cycle of the paper-making machine. Preferably, this addition is performed before the addition of the calcium hydroxide, in order to ensure the dissolution of the gas and thus to subsequently encourage the speed of the reaction with the calcium hydroxide in order to form the precipitated vaterite crystals.

Preferably, most of the carbon dioxide is added in the course of the white water recycling cycle of the paper-making machine. At the start of the cycle, the carbonic (carbon dioxide) gas participates in the solubilization of the recycled calcium carbonate, in the form of calcium hydrogen carbonates, present in the white water. The calcium carbonate will subsequently be recrystallized during reaction with the calcium hydroxide.

According to a particular embodiment of the invention, the process is characterized by the fact that the addition of said gaseous carbon dioxide takes place between the white water receiving site under the wire of the paper-making machine and the mineralizer. This will encourage full dissolution of the gas before the reaction with calcium hydroxide. In fact, it is preferable for the carbon dioxide to be added during the recycling cycle of the white water, so that it is entirely dissolved, in free form, in hydrated form, or in the form of calcium hydrogen carbonates or other alkaline or alkaline-earth salts, depending upon which of these ions are present.

An advantage of this process is that the fibers are not placed in contact with an alkaline product; this improves the homogeneity of the paper, which is known as "look-through," because the fibers have a tendency to clump together in an alkaline environment. During recrystallization of the carbonate in the presence of fibers, the medium remains neutral; this improves the efficacy of the sizing agents and the optical agents, which are alkaline pH-sensitive.

An advantage of this process, introducing the carbonic gas at the beginning of the cycle (optimal dilution point for hydration of the gas) and in a machine adapted for mineralization of water, is that it is easier to use a gas with a low $CO_2$ content, recovered from a boiler or a lime kiln, in order to transform it into calcium hydrogen carbonate.

According to a particular embodiment of the invention, the process is characterized by the fact that the carbon dioxide is introduced in the form of diluted carbonic gas, specifically fumes from a boiler or a limekiln, containing 8% to 25% of $CO_2$.

In the process according to the invention, the molar ratio of carbon dioxide to calcium hydroxide is equal to approximately 1, and is therefore stoichiometric.

Furthermore, the process according to the invention is also advantageously characterized by the fact that the dilution rate of the paper fibers in the final reaction mixture ranges from 0.1% to 5% by weight, preferably from 0.2% to 1.5%.

Preferably, the process according to the invention is characterized by the fact that the composition containing the calcium hydroxide is an aqueous suspension of solid particles of said calcium hydroxide, known as milk of lime.

More particularly, the process according to the invention is characterized by the fact that the calcium hydroxide is in the form of an aqueous suspension of solid particles with a grading lower than 10 μm, preferably between 0.5 and 2 μm, and particularly on the order of 1 μm.

Figure 2:
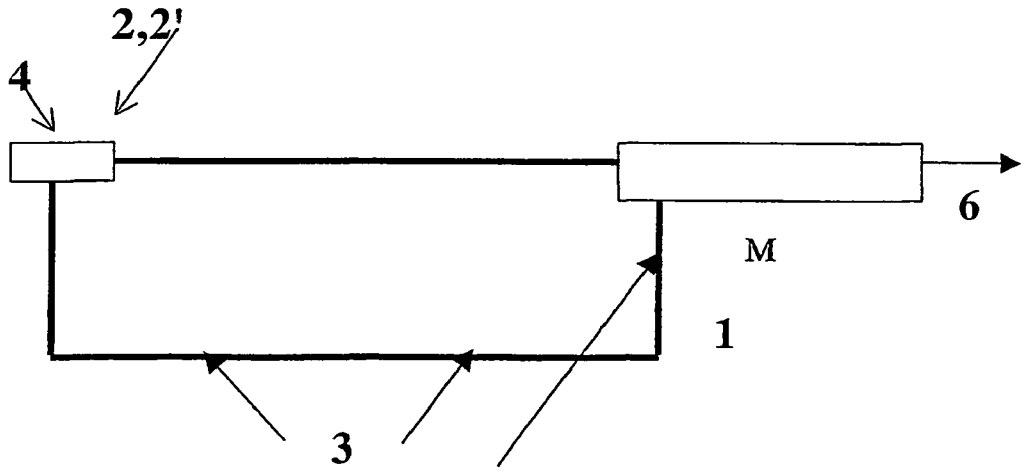
Figure 3:
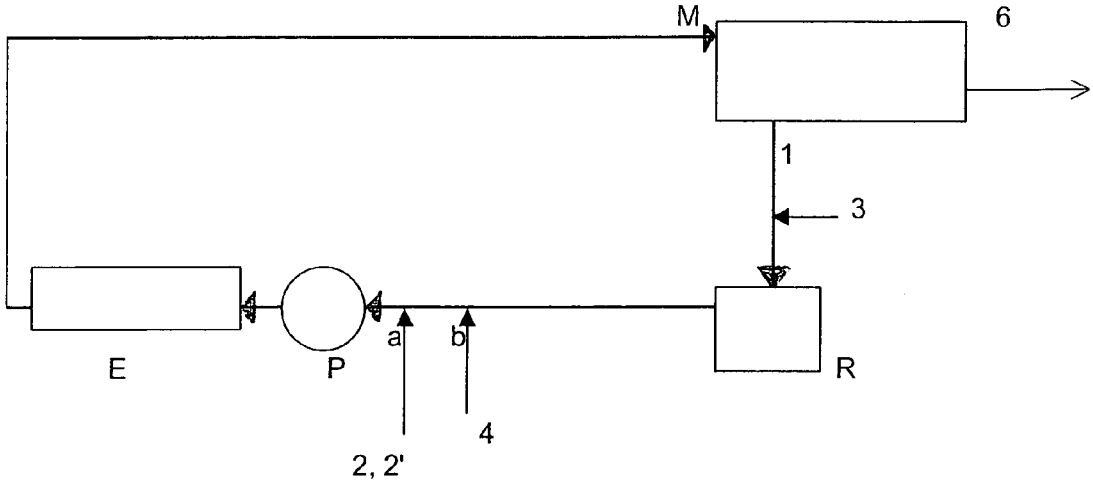

FIGS. 1 to 3 provide a diagram description of particular embodiments of this process, wherein the relative proportions are not shown in real scale.

FIG. 1 describes a process according to which a composition of calcium hydrogen carbonates (5) is introduced into an aqueous medium, to which a calcium hydroxide suspension (4) is added in order to precipitate the vaterite crystals, and, immediately afterward, virgin paper fibers (2) and/or recycled paper fibers (2') are added and the vaterite crystals are allowed to transform into calcite crystals upon contact with the fibers, after which the sheet (6) is shaped and drained on the paper-making machine (M).

FIG. 2 represents a process according to which carbonic gas (3) is introduced into the white water recycling cycle (1), after which a calcium hydroxide suspension (4) is added in order to precipitate the vaterite crystals, and, immediately afterward, virgin paper fibers (2) and/or recycled paper fibers (2') are added and the vaterite crystals are allowed to transform into calcite crystals upon contact with the fibers, after which the sheet (6) is shaped and drained on the paper-making machine (M).

FIG. 3 represents the simplified diagram of a detailed, non-limitative example that describes the manufacture of a paper (6) with a 26% filler of calcium carbonate, principally in the form of calcite, in the following manner:

Let us assume that an industrial installation manufactures 5.4 metric tons of paper per hour, characterized by the following operating conditions for the principal cycles:

- Average flow rate of the suspension into the headbox: 1100 $m^3$ per hour
- Average flow rate of the short recycled water cycle: 1000 $m^3$ per hour
- Average flow rate of the input cycle of virgin fibers and recycled paper: 100 $m^3$ per hour
- Water temperature in the cycle: 40° C.

The average composition of the suspension of virgin fibers (2) and recycled paper (2') consists of 28 g/L of virgin fibers and 16 g/L of recycled paper coming from the same production, which itself includes 12 g/L of fiber and 4 g/L of calcium carbonate (recycled). The average composition of the recycled white water (1) consists of 1 g/L of fiber and 1 g/L of calcium carbonate (recycled).

Upstream of the pump (P) for recovering the white water (1) recovered under the wire of the paper-making machine, a quantity of carbonic gas (3) equal to 440 kg/hour of $CO_2$ is initially introduced into the closed short cycle. Then, after the mineralizer (R), milk of lime (4), containing 100 g/L of very fine-grained (approximately 1 μm) calcium hydroxide is added at a flow rate of 7.4 $m^3$ per hour. Finally, the suspension containing virgin fibers (2) and recycled paper (2') is introduced.

The gas reacts almost instantaneously with the milk of lime, in order to form, in suspension in the water, unstable vaterite crystals between points a and b; subsequently, after being mixed with the fibrous suspension (2, 2') and before reaching the headbox (E), the vaterite crystals are transformed into stable calcite. The suspension of fibers and fillers is then conveyed onto the wire of the paper-making machine (M) for drainage and formation of the sheet of paper.

When the virgin fibers and the recycled paper are added, the pH of the suspension is stabilized at its final value, adjustable between 7 and 8 as desired, which corresponds to a calcium-carbon balance of the water.

The output of the paper-making machine consists of 5.4 tons of paper with a 26% filler of crystals, essentially in the form of rhombohedral calcite.

The size of the calcite crystals becomes smaller as the grading of the milk of lime becomes finer. The paper obtained will accordingly be more opaque when the milk of lime used contains grains less than 1 μm in dimension.

The high opacity of the sheet (6) is obtained by virtue of the very consistent distribution of the crystals hooked on to the fibers, without the help of a retention agent and without any variation in the pH. In comparison with the traditional process of filler retention with formation of aggregates by means of a retention agent, the improvement in opacity is between 3 and 4 points.

EXAMPLE FROM THE PRIOR ART

A sheet of paper is made according to the prior art whereby calcium carbonate is precipitated in situ, mixing the compounds at the same time without specifically adding the paper fibers last, and without adding them immediately after implementing the precipitation of the calcium carbonate.

It will be noted that the sheet of paper obtained according to the invention contains calcite crystals that are better distributed than those in the sheet of paper prepared according to the prior art, and that, accordingly, the "look-through" of said sheet of paper obtained according to the invention is improved.

The invention claimed is:

1. A process for the manufacture of a sheet of paper containing paper fibers and calcium carbonate, mostly in the form of calcite crystals directly linked to the paper fibers, wherein said process includes the steps of:

providing an aqueous composition containing calcium hydrogen carbonates and/or hydrated and/or dissolved carbon dioxide;

adding thereto an aqueous composition which is an aqueous suspension of solid particles of calcium hydroxide, known as milk of lime, so as to precipitate calcium carbonate in the form of vaterite crystals, wherein the calcium hydroxide is in the form of solid particles with an average grading between 0.5 and 2 μm;

immediately adding paper fibers;

allowing the vaterite crystals to be transformed into calcite crystals upon contact with the fibers;

placing this mixture containing the calcite crystals fixed to the fibers onto the wire of the paper-making machine for drainage and formation of the sheet of paper; and processing (if necessary) and drying the sheet of paper thus obtained.

2. The process of claim 1, wherein the composition containing calcium hydrogen carbonates results from a mixture of recycled calcium carbonate and carbon dioxide.

3. The process of claim 2, wherein the recycled calcium carbonate comes from recycled paper products.

4. The process of claim 1, wherein the carbon dioxide is added before the addition of the calcium hydroxide, in the white water recycling cycle of the paper-making machine.

5. The process of claim 1, wherein the carbon dioxide is introduced into said aqueous composition in the form of diluted carbonic gas.

6. The process of claim 1, wherein the dilution rate of the paper fibers in the final reaction mixture ranges from 0.1% to 5% by weight.

7. The process of claim 1, wherein the sheet of paper obtained includes at least 10% of calcium carbonate crystals in the form of rhombohedral calcite.

8. The process of claim 3, wherein the recycled calcium carbonate comes from recycled paper fibers and/or recycled white water.

9. A process for the manufacture of a sheet of paper containing paper fibers and calcium carbonate, mostly in the form of calcite crystals directly linked to the paper fibers, wherein said process includes the steps of:

providing an aqueous composition containing calcium hydrogen carbonates and/or hydrated and/or dissolved carbon dioxide, wherein the carbon dioxide is introduced into said aqueous composition in the form of diluted carbonic gas, which diluted carbonic gas is in the form of fumes from a boiler or a lime kiln containing 8% to 25% of $CO_2$;

adding thereto an aqueous composition which is an aqueous suspension of solid particles of calcium hydroxide, known as milk of lime, so as to precipitate calcium carbonate in the form of vaterite crystals, wherein the calcium hydroxide is in the form of solid particles with an average grading between 0.5 and 2 μm;

immediately adding paper fibers;

allowing the vaterite crystals to be transformed into calcite crystals upon contact with the fibers;

placing this mixture containing the calcite crystals fixed to the fibers onto the wire of the paper-making machine for drainage and formation of the sheet of paper; and processing (if necessary) and drying the sheet of paper thus obtained.

10. The process of claim 6, wherein the dilution rate of the paper fibers in the final reaction mixture ranges from 0.2% to 1.5% by weight.

11. The process of claim 1, wherein the calcium hydroxide is in the form of solid particles with an average grading on the order of 1 μm.

12. The process of claim 7, wherein the sheet of paper obtained includes at least 20% of calcium carbonate of the calcite type thus precipitated.

13. The process of claim 4, wherein the carbon dioxide is introduced into said aqueous composition in the form of diluted carbonic gas.

14. A process for the manufacture of a sheet of paper containing paper fibers and calcite crystals directly linked to the paper fibers, said process comprising the steps of:

introducing diluted carbonic gas in the form of fumes from a boiler or a lime kiln containing 8% to 25% of $CO_2$ into an aqueous composition to provide an aqueous composition containing calcium hydrogen carbonates and/or hydrated and/or dissolved carbon dioxide;

adding, to the resulting aqueous composition containing calcium hydrogen carbonates and/or hydrated and/or dissolved carbon dioxide, an aqueous composition which is an aqueous suspension of solid particles of calcium hydroxide in the form of solid particles with an average grading between 0.5 and 2 μm to precipitate calcium carbonate in the form of vaterite crystals;

immediately adding papermaking fibers to the resulting aqueous composition containing vaterite crystals;

allowing the vaterite crystals to be transformed into calcite crystals fixed to said papermaking fibers; and placing the resulting aqueous mixture containing calcite crystals fixed to papermaking fibers onto a wire of a papermaking machine to form a sheet of paper, wherein the sheet of paper thus obtained includes at least 20% of calcium carbonate of the calcite type directly linked to the paper fibers.

* * * * *